US005356027A

United States Patent [19]

Craft et al.

[11] Patent Number: 5,356,027

[45] Date of Patent: Oct. 18, 1994

[54] PIVOTING LID ATTACHMENT FOR REFUSE CONTAINER

[75] Inventors: Charles W. Craft, Apple Creek; Mitchell L. Wilgus, Akron, both of Ohio

[73] Assignee: Rubbermaid Incorporated, Wooster, Ohio

[21] Appl. No.: 95,405

[22] Filed: Jul. 23, 1993

[51] Int. Cl.[5] ..... B65D 51/04

[52] U.S. Cl. ..... 220/338; 220/337; 220/908; 16/257; 16/271; 16/272

[58] Field of Search ..... 220/337, 338, 335, 908; 16/254, 257, 260, 271, 272

[56] References Cited

U.S. PATENT DOCUMENTS

| | | | |
|---|---|---|---|
| D. 261,720 | 11/1981 | Brazis | D34/9 |
| D. 277,898 | 3/1985 | Paul et al. | D34/11 |
| D. 324,595 | 3/1992 | Beese et al. | D34/5 |
| 722,624 | 3/1903 | Pickop | 16/271 |
| 3,432,882 | 3/1969 | Farouche | 16/257 |
| 3,823,973 | 7/1974 | Ramer | 294/73 |
| 4,193,164 | 3/1980 | Okayama | 16/141 |
| 4,314,651 | 2/1982 | Gaiser et al. | 220/326 |
| 4,349,120 | 9/1982 | DiNardo | 220/337 |
| 4,354,543 | 10/1982 | Bogner | 150/50 |
| 4,401,312 | 8/1983 | Parker | 280/47.17 |
| 4,450,976 | 5/1984 | Synder et al. | 220/343 |
| 4,598,889 | 7/1986 | Remington | 16/260 X |
| 4,663,803 | 5/1987 | Gora | 16/266 |
| 4,749,101 | 6/1988 | Durkan | 220/337 |
| 4,780,928 | 11/1988 | De Lorenzo Poz | 16/228 |
| 4,789,078 | 12/1988 | Miller et al. | 220/335 |
| 4,836,394 | 6/1989 | Glomski | 220/1 |
| 4,914,781 | 4/1990 | Sokn et al. | 16/225 |
| 4,930,649 | 6/1990 | Moser | 220/338 X |
| 4,972,966 | 11/1990 | Craft | 220/264 |
| 5,063,638 | 11/1991 | Howard et al. | 16/238 |
| 5,071,024 | 12/1991 | Delmerico et al. | 220/335 |
| 5,088,750 | 2/1992 | Beese et al. | 280/47.26 |
| 5,129,535 | 7/1992 | Hradisky | 220/23.4 |
| 5,217,135 | 6/1993 | Smith et al. | 220/335 |

*Primary Examiner*—Allan N. Shoap
*Assistant Examiner*—Vanessa Caretto
*Attorney, Agent, or Firm*—Richard B. O'Planick; Lisa B. Riedesel

[57] ABSTRACT

A refuse container (2) is disclosed comprising a base receptacle (4) and a lid (6). A pair of support plates (16) are spaced apart and connected to the rearward sidewall (9) of the base (4) and a pivot pin (28) is located at a distal end of each support plate (16) and extends normally therefrom. Each pivot pin (28) comprises a smaller diameter shank portion (30) and a larger diameter end cap (32). The lid is configured to have a pair of spaced apart arms (42,44) projecting from a rearward side, each arm having a peanut-shaped aperture (48) through an inward facing sidewall (56) thereof. The aperture (48) receives an associated pivot pin (28) through a larger aperture portion (50) thereof, and the lid is pushed forward to position by force fit the shank portion (30) in a smaller aperture portion (52). A pivoting connection is thereby established between the lid and the base, and the lid is free to pivot from a location on top of the base to a position adjacent a rearward sidewall (9) of the base.

18 Claims, 7 Drawing Sheets

PIVOTING LID ATTACHMENT FOR REFUSE CONTAINER

BACKGROUND OF THE INVENTION

1. Field of the Invention

The invention relates generally to refuse containers of the type comprising a lid and a base receptacle, and more particularly to such containers which provide a lid which is pivotally attached to the top of the receptacle and moves from a closing position to an open position.

2. The Prior Art

Refuse containers having a lid pivotally attached to the base receptacle are well known. U.S. Pat. No. 5,071,024 discloses such a container. As described in the patent, the lid is pivotally attached to support brackets at the rear of the container, by means of dual pivot pins which are inserted through the lid and into a tubular channel of the container. So inserted, the pins provide a permanent pivot axis about which the lid may move from a closing position, in which it covers the container base, to an open position situated against the rearward wall of the container.

While the aforementioned patented container, and like configured containers, work well and have been well accepted commercially, certain shortcomings prevent them from representing an optimum solution to the needs of consumers and manufacturers.

One deficiency results from the fact that the lid is intended to be permanently attached to the container. If such attachment is done by the manufacturer, the containers can not be nested for shipping efficiency, resulting in a higher shipping cost and a consequentially higher selling price. If, on the other hand, the lid and its assembly hardware are shipped detached from the container for assembly by the end user, the relative laborious assembly required of the end user detracts from the products appeal.

Moreover, certain uses of the container may be more easily done with the lid detached, and a permanently affixed lid, or one which is difficult to remove and reattach, is ill suited for such tasks.

In addition, the hardware for pivotally attaching the lid is expensive, or may be lost in transit; further shortcomings to conventional refuse container configurations.

U.S. Pat. No. 4,749,101 discloses a refuse container which overcomes some, but not all, of the deficiencies set forth above. The patented container is taught to be rotationally molded, and has a handle having frustroconical pins extending outward from both ends. The container has arms which are molded having frustroconical sockets into which the pins are inserted by a flexing of the container lid.

The primary disadvantage of such a configuration is that the frustro-conical structure within the lid arms cannot be molded by injection molding, or out of injection mold grade plastics material. The container lid must be molded out of higher grade material, by rotational molding (a slower and hence more expensive process), making the resultant cost of the product higher.

Further, the arms of the lid must be flexed outward a considerable distance to clear the pins of the container handle, an action requiring considerable force. As a result, the container is not ideally suited for applications which require that the lid be easily and frequently removed and re-attached.

Lastly, the pin in socket configuration is highly frictional having the surfaces of the pins and sockets in contact at all time, and, over time, repeated pivotal openings of the lid will cause wear at the connection, making the connection loose fitting and insecure with age.

SUMMARY OF THE INVENTION

The subject invention solves the needs of the market by providing a refuse container, molded of conventional plastics material, which can be shipped in a nested condition for efficiency, and a pivotal lid which is easily attached and detached from the container by the end user, without the use of hardware. The container provides first and second support plates projecting from a rearward wall, each support plate having an outward projecting, integrally molded, pivot post at a distal end. The pivot post has a small diameter shank portion and a larger diameter end cap.

A lid is provided and includes a pair of spaced apart assembly arms, each having an inward facing surface and a keyhole, or peanut-shaped aperture located at a distal end and extending through the inward arm surface. The aperture is dimensioned to receive the pivot post end cap through a larger aperture portion, and, subsequently, the shank portion of the pivot post is press fit into a smaller portion of the aperture to attach the lid to the support brackets. A removal of the lid may be effected by reversing the procedure.

The spacing between the arms is slightly less than the spacing between the container brackets, such that the arms must be flexed outward to allow the pivot posts to enter their associate apertures. The arms exert a residual spring force against the container brackets, providing a positive fit between the lid arms and the container brackets.

Accordingly, it is an objective to provide a refuse container having a lid to container pivot attachment which requires no assembly hardware and which can quickly and readily facilitate the attachment and detachment of the lid from the base.

A further objective is to provide a refuse container lid to base attachment which may be shipped in a nested condition and easily assembled by the end user.

Still a further objective is to provide a refuse container which utilizes the resiliency of its material composition to effect a positive attachment of the lid component to the base.

Another objective is to provide a lid to container pivotal connection which is low in friction, and which can be molded of relatively low grade plastics by an injection molding process.

Yet a further objective is to provide a refuse container which economically and readily manufactured, shipped, and assembled.

These, and other objectives, which will be apparent the those skilled in the art, are achieved by a preferred embodiment which is described in detail below, and which is illustrated by the accompanying drawings.

DESCRIPTION OF THE ACCOMPANYING DRAWINGS

DESCRIPTION OF THE PREFERRED EMBODIMENT

Figure 1:
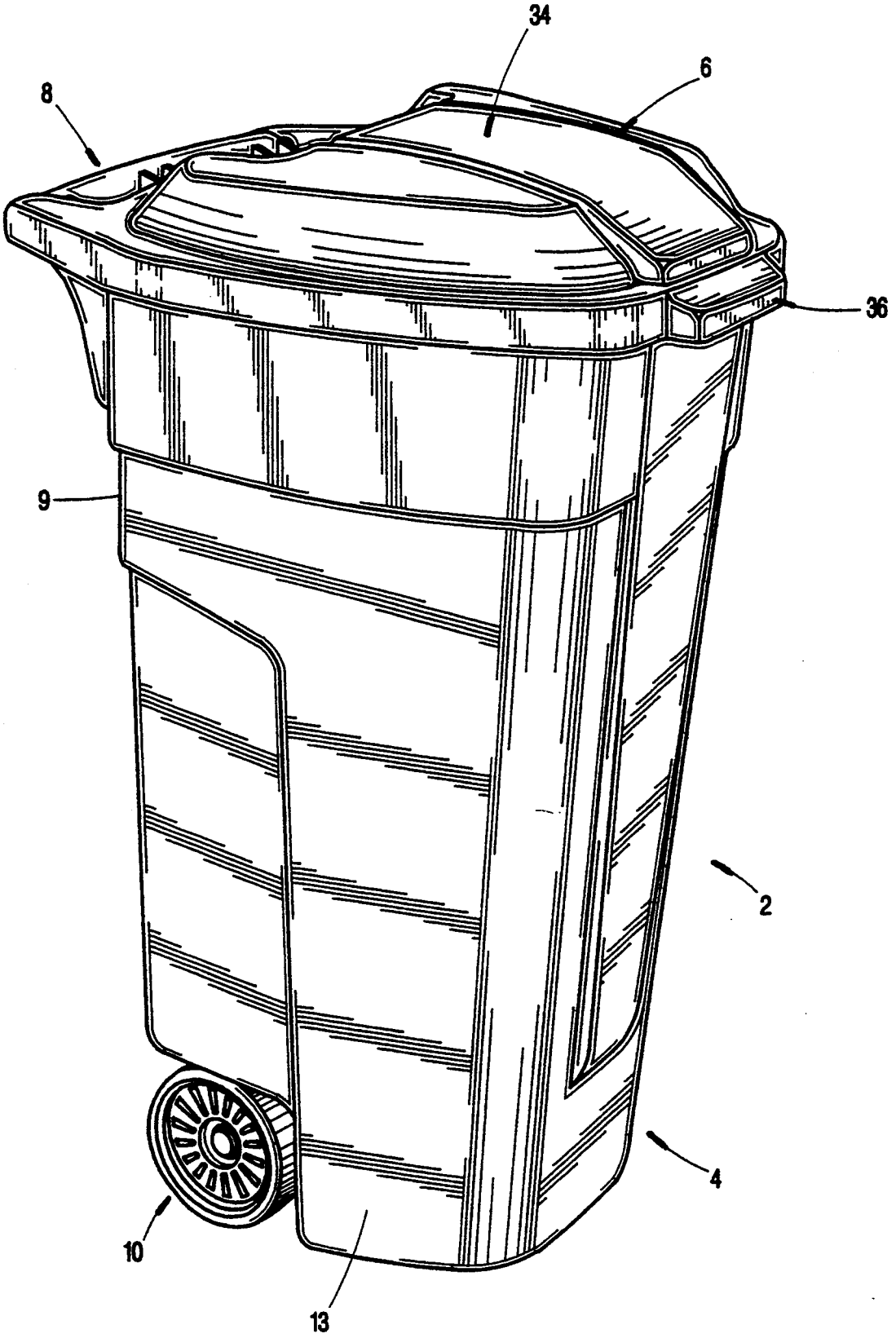
FIG. 1 is a perspective view of the assembled refuse container comprising the subject invention.
Figure 2:
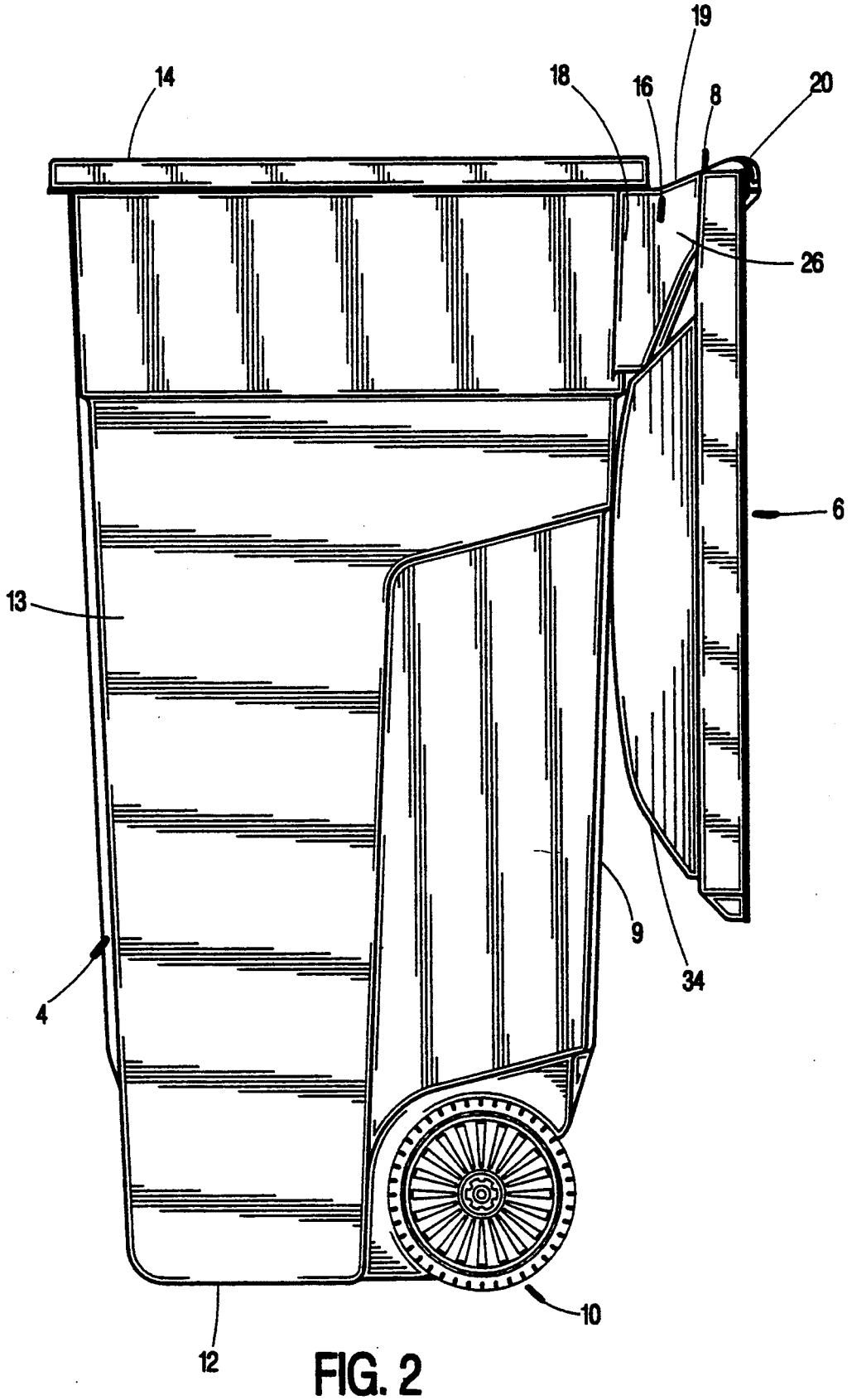
FIG. 2 is a side elevation view thereof, shown with the lid in the open condition.
Figure 3:
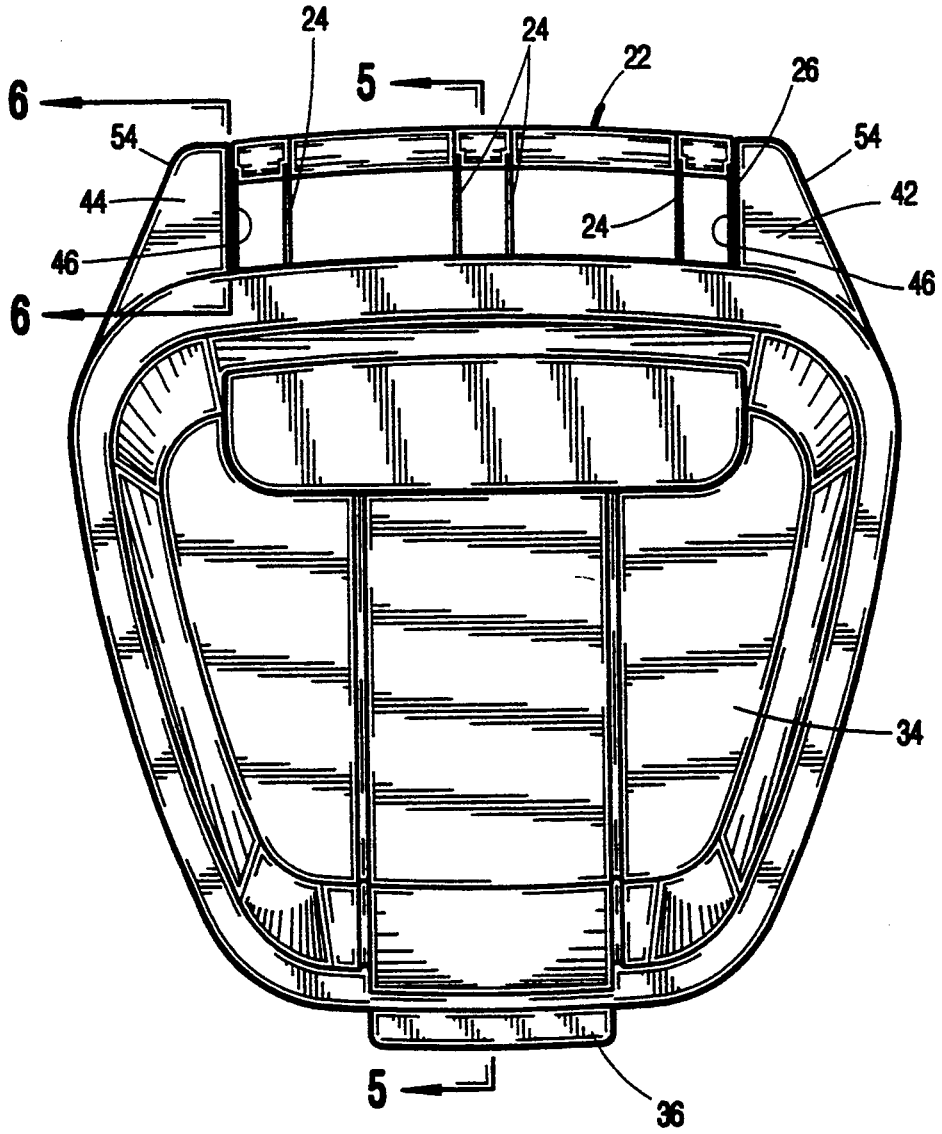
FIG. 3 is a top plan view of the container of FIG. 1.

Referring first to FIGS. 1, 2, and 3, the subject refuse container 2 is shown to comprise a base receptacle 4 and a lid component 6. The container and lid are molded by conventional injection molding means of commercially available material, preferably linear low density polyethylene.

The base 4 is shown to be of generally trapezoidal cross section, and includes an integrally molded handle 8 extending across a rearward sidewall 9. At the bottom rearward comer of the base 4 are spaced apart wheels 10 such that a user, by pulling back of the handle 8, can wheel the refuse container about.

The base receptacle 4 is formed having a bottom 12, and sidewalls 13 extending upwardly therefrom to a downturned upper rim flange 14. A pair of right -triangle -shaped support plates or brackets 16 extend rearward from an upper portion of rearward sidewall 9. The support plates 16 are positioned such that an inward vertical side 18 extends downward along the rearward container sidewall 9, and a second plate side 19 extends horizontally to a distal outward plate nose 20.

A handle bar 22 of inverted U-shaped cross-section spans the support plate nose portions 20 and is generally level with the upper rim 14 of the container base 4. Reinforcement plates 24 are molded between the handle bar 22 and container rearward sidewall 9 as shown, for structural strength. The lid component 6 attaches to outward facing surfaces 26 of the support plates 16 as described below.

Figure 8:
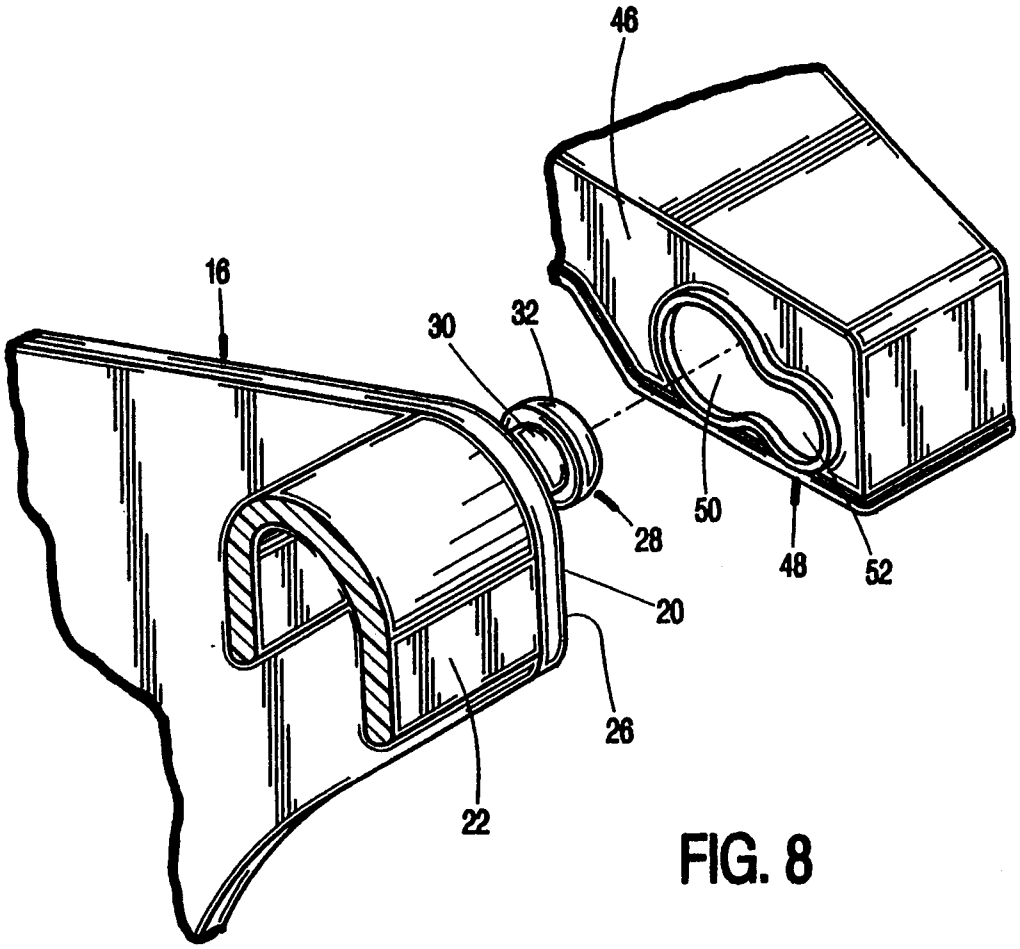
FIG. 8 is an enlarged perspective view of the pivot attachment in the exploded condition.

As best viewed from FIG. 8, each support plate 16 is formed to provide an assembly pivot pin 28, positioned proximate the nose portion 20, and extending normally from the outward support plate surface 26. The pivot pins 28 of the support plates 16 are generally in line with the handle bar 22 as shown. Each pivot pin comprises a cylindrical shank portion 30 connected at one end to the support plate 16, and a distal end cap 32 connected to the opposite end of the shank portion 30. The shank portion 30 is of circular cross section of a relatively small diameter, and the circular end cap 32 is of relatively larger diameter.

Referring to FIGS. 1, 2, 3, and 5, the lid 6 is shown to comprise a domed central cover portion 34 of trapezoidal top plan shape. A rectangular handle 36 is provided at a forward lid side, and an underneath retention flange 38 projects back toward the center of the lid. The flange 38 terminates at a retention flange edge 40 which, as best seen from FIG. 5., resiliently snaps under the downturned rim flange 14 of the base 4 to lock the lid in place.

At the rearward side of the lid 6 are a pair of spaced apart and parallel arms 42,44, which project rearward from the domed portion 34. The arms are unitarily molded of plastics material and are formed to provide inside facing surfaces 46. Positioned within the surfaces 46 proximate the free ends of the arms 42,44 are apertures 48. Each aperture 48 is of a keyhole or peanut shape, comprising a large portion 50, oriented toward the lid domed portion, and a smaller aperture portion 52, which is located furthermost away from the lid domed portion.

The assembly of the lid 6 to the base 4 proceeds as follows. The spacing between the lid arms 42,44 is slightly smaller than the spacing between the base support plates 16, essentially the length of the end caps 32 of the pivot pins 28, such that arms 42,44 must be flexed outward to fit to the outside of their respective support plate. It will be appreciated, therefore, that the arms must only be flexed outward the combined width of the end caps in order to achieve assembly.

As illustrated by FIG. 8, the end cap 32 of the pivot pin 28 is brought into alignment and inserted through the large portion 50 of the aperture 48. Thereafter, the lid is pushed forward until the shank portion 30 inserts by press fit into the smaller aperture portion 52. The end cap 32 prevents the lid from exiting the aperture portion 52 in the lateral direction and the press fit between the pivot pin shank portion 30 and the aperture walls defining aperture portion 52 prevents the lid from sliding backward.

As will be appreciated, after flexing the lid arms 42,44 outward and to the outside of the support plates 16, upon release, the arms 42,44 exert a residual inwardly directed spring force on the outside surface 26 of the support plates 16 and secure the pivot pin connection. The lid can pivot about pins 28 two hundred and seventy degrees from the closed position illustrated by FIG. 1 to the open position illustrated in FIG. 2. Moreover, the only contact between the pivot pins and the lid at the pivot connection is a thin line of contact between the circumference of the shank portion of the pivot pins 28 and the edges defining the peanut-shaped aperture portion 52. A low friction pivot connection is accordingly created which makes the lid pivot more easily, and also reduces friction induced wear which, over time, could deteriorate the pivot connection. The assembly of the lid to the base, as described above, is without hardware and is easily done in seconds.

Moreover, the disassembly of the lid from the base may be effected just as easily, by reversing the procedure described above. The outward flexure of the lid arms need only be enough to allow the peanut-shaped aperture to clear the end cap of the pivot pins 28. Hence, the container 2 may be shipped internested with like-configured containers with the lids removed, for shipping space efficiency. The user can assemble the lid to the base easily and without tools and hardware for those applications requiring a lid, yet as easily remove the lid, as frequently as necessary, for applications which do not require the lid.

FIG. 2 illustrates the lid in the open condition. As shown, the domed center 34 of the lid interfits against the rearward sidewall 9 of the container, below the support plates 16. The lid is between a vertical plane extending through the handle bar and the rearward sidewall 9 of the base 4. So located, the lid is out of the way of the user at the handle bar.

Figure 4:
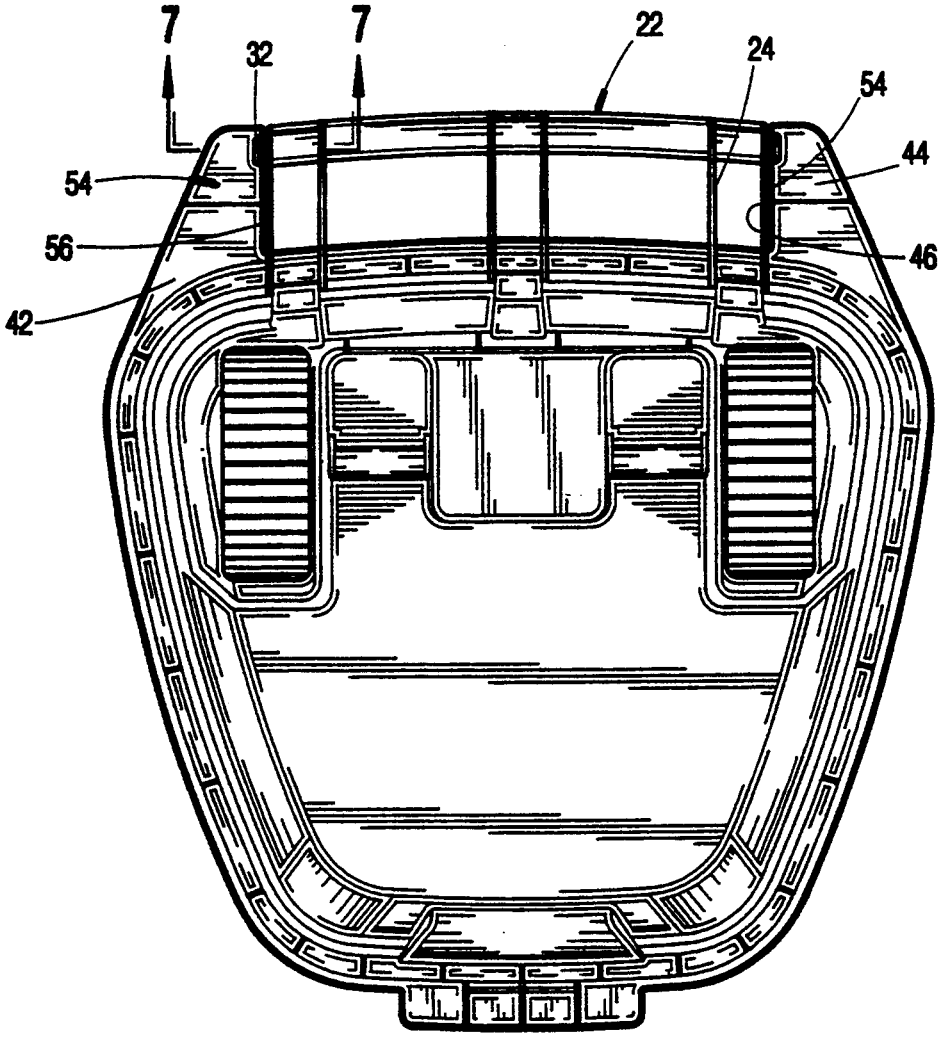
FIG. 4 is a bottom plan view thereof.
Figure 5:
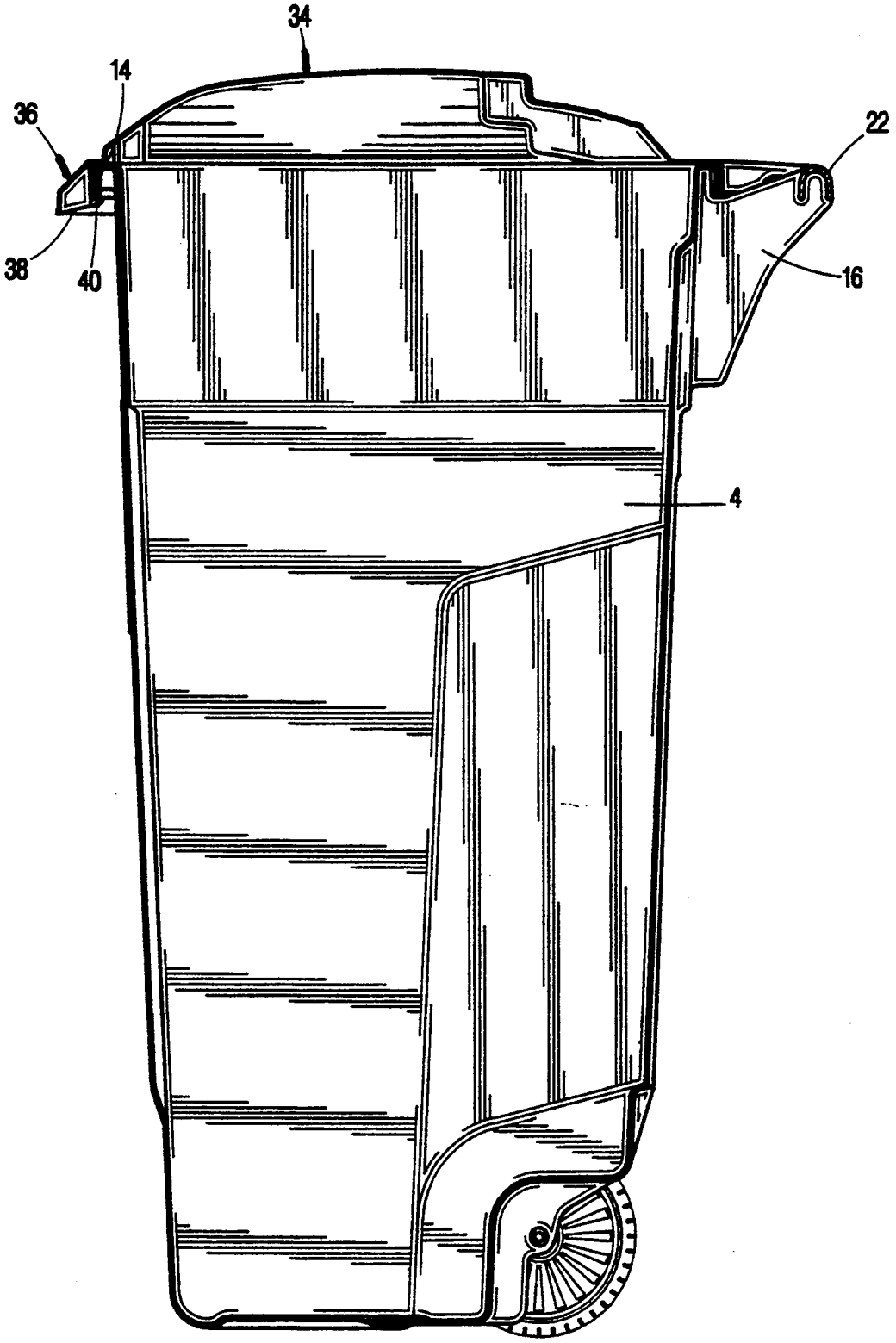
FIG. 5 is a side elevational view thereof.
Figure 6:
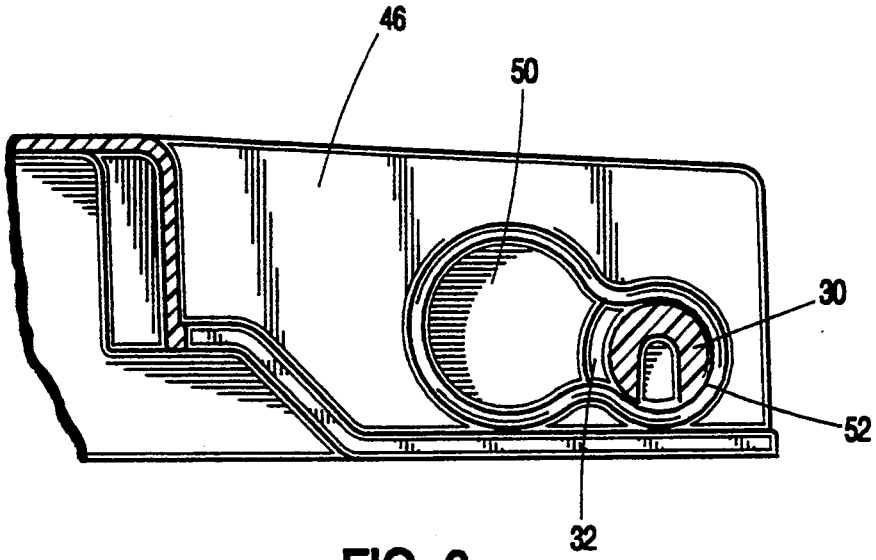
FIG. 6 is sectional view of the pivot attachment taken along the line 6—6 of FIG. 3.
Figure 7:
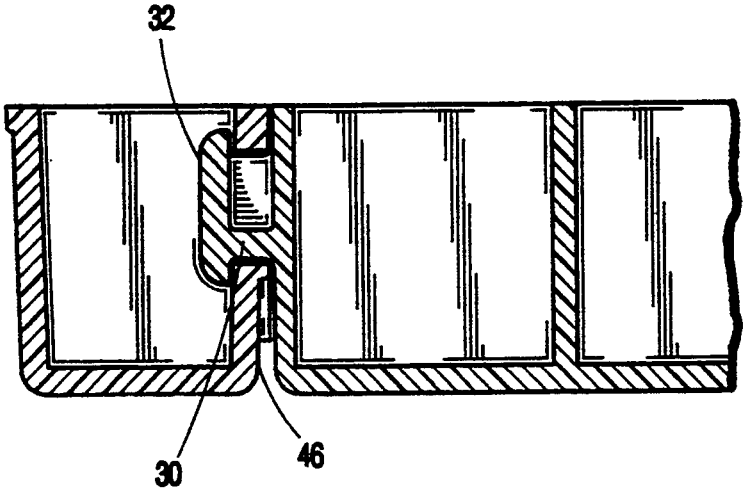
FIG. 7 is a sectional view of the pivot attachment taken along the line 7—7 of FIG. 4.

From FIGS. 3 and 4 it will be apparent that the arms 42,44 of the lid are of double walled construction, comprising an outer wall 54, and an inner wall 56 which define an enclosed cavity. The end cap 32 of the pivot pin projects through the inner wall 56 and resides within the cavity in the assembled state.

It will be readily noted that the subject lid and base receptacle may be unitarily formed by injection molding and require no hardware for assembly. The cost of the refuse container is thereby minimized. Further, the lid may be attached or disattached quickly and easily at the option of the user without handtools.

While the above describes the preferred embodiment of the subject invention, the invention is not intended to be so confined. Other embodiments, apparent to those skilled in the art, which utilize the teachings hereof, are intended to be within the scope and spirit of the present invention.

We claim:

1. A refuse container comprising:

a container base comprising a bottom and sidewalls extending from the bottom to an upper rim and defining therebetween an internal chamber;

first and second support plates attached at one end to a rearward container base sidewall and having a second distal end extending outward therefrom, each support plate having an outward facing surface and a pivot post projecting outward therefrom and located proximate the distal plate end, each said pivot post having a shank portion attached at one end to the outward plate surface and an end cap attached to a distal end of the shank portion;

a lid having a central cover portion for enclosing a top of the container base chamber and first and second spaced apart arms, each connected at a first end to a rearward end of the cover portion and having a second distal end extending outward therefrom, and each of the arms having an inward facing surface and an enclosed keyhole-shaped aperture through the inward facing surface and located proximate the distal arm end, each said keyhole-aperture having a relatively large portion for receipt of one said pivot post end cap therethrough and a relatively small portion dimensioned to receive the one pivot post shank portion.

2. A refuse container according to claim 1, wherein the lid arms being composed of resilient material and having a spacing therebetween less than the spacing between the container base support plates, whereby the lid arms flex outwardly to fit outside the support plates and exert an inwardly directed residual spring force against the support plate outward surface to facilitate a spring biased receipt of the pivot posts into the keyhole apertures.

3. A refuse container according to claim 1, wherein the lid pivots about the container base pivot posts from a horizontal orientation in which the lid encloses the container base chamber to a vertical orientation adjacent the rearward surface of the container base.

4. A refuse container according to claim 3, wherein the distal ends of the support plates extend from the rearward container base sidewall a distance substantially equivalent to the length of the lid arms.

5. A refuse container according to claim 4, wherein the support plates extend down the rearward sidewall of the container base a distance substantially equivalent to the length of the lid arms.

6. A refuse container according to claim 5, wherein further comprising a handle bar extending between the support plates and attached at opposite ends thereto.

7. A refuse container according to claim 6, wherein the large keyhole portion is positioned toward the container base and the smaller keyhole portion is positioned toward the distal end of the lid arms.

8. A refuse container according to claim 7, wherein the lid cover portion has a domed profile extending upward with the lid positioned on the container base and inward toward the container base and below said support plates with said lid in the vertical orientation.

9. A refuse container according to claim 8, wherein the lid in the vertical orientation residing between a vertical plane extending through the handle bar and the rearward sidewall of the base container.

10. A refuse container comprising:

a container base configured having a bottom and sidewalls extending from the bottom to an upper rim and defining therebetween an internal chamber;

first and second substantially right angle-shaped support plates attached along one vertical side to a rearward container base sidewall and having a second side extending outward therefrom and terminating at a distal end, each support plate having an outward facing surface and a pivot post located proximate the distal plate end and extending out normal to the plate outward surface, each said pivot post having a shank portion attached at one end to the outward plate surface and an end cap attached to a distal end of the shank portion;

a lid having a central cover portion for enclosing a top of the container base chamber and first and second parallel and spaced apart arms, each arm connected at a first end to a rearward end of the cover portion and having a second distal end extending in cantilever fashion outward therefrom, and each of the arms having an inward facing surface and an enclosed keyhole-shaped aperture located proximate the arm distal end and extending through the ann inward facing surface, each said keyhole-shaped aperture having a relatively large portion for receipt of one said pivot post end cap therethrough and a relatively smaller portion for receipt of one said pivot post shank portion.

11. A refuse container according to claim 10, wherein the lid arms being composed of resilient plastics material and having a spacing therebetween less than the spacing between the container base support plates, whereby the lid arms flex outwardly to fit outside the support plates and exert an inwardly directed residual spring force against the support plate outward surfaces to facilitate a spring biased assembly of the lid to the container base by receipt of the pivot posts into the keyhole apertures.

12. A refuse container according to claim 10, wherein the lid pivots two hundred and seventy degrees about the container base pivot posts from a horizontal orientation in which the lid encloses the container base chamber to a vertical orientation adjacent the rearward surface of the container base.

13. A refuse container according to claim 12, wherein the support plate second sides are dimensioned substantially equivalent to the length of the lid arms.

14. A refuse container according to claim 13, wherein the support plate first sides are dimensioned substantially equivalent to the length of the lid arms.

15. A refuse container according to claim 14, wherein further comprising a handle bar attached at opposite ends to the support plates and extending therebetween collinear with the pivot post shank portions.

16. A refuse container according to claim 15, wherein the large keyhole-aperture portion is positioned toward the container base and the smaller keyhole portion is positioned toward the distal end of the lid arms.

17. A refuse container according to claim 16, wherein the lid cover portion has a domed profile positioned above the container base chamber in the horizontal orientation and below the support plate second sides with the lid in the vertical orientation.

18. A refuse container according to claim 17, wherein the lid in the vertical orientation residing between a vertical plane extending through the handle bar and the rearward sidewall of the base container.

* * * * *